US010772449B2

(12) United States Patent
Tannehill

(10) Patent No.: US 10,772,449 B2
(45) Date of Patent: Sep. 15, 2020

(54) FOLDING POPCORN HOLDER

(71) Applicant: Thomas J. Tannehill, Fife Lake, MI (US)

(72) Inventor: Thomas J. Tannehill, Fife Lake, MI (US)

( * ) Notice: Subject to any disclaimer, the term of this patent is extended or adjusted under 35 U.S.C. 154(b) by 38 days.

(21) Appl. No.: 16/280,559

(22) Filed: Feb. 20, 2019

(65) Prior Publication Data

US 2019/0261797 A1 Aug. 29, 2019

Related U.S. Application Data

(60) Provisional application No. 62/635,295, filed on Feb. 26, 2018.

(51) Int. Cl.
*A47G 23/06* (2006.01)
*A47C 7/62* (2006.01)

(52) U.S. Cl.
CPC ..... *A47G 23/0641* (2013.01); *A47C 7/624* (2018.08); *A47G 23/0625* (2013.01)

(58) Field of Classification Search
CPC ..... A47C 7/624; A47C 7/622; A47G 23/02; A47G 29/08; A47G 23/0641; A47G 23/0625; A47J 43/00; A47J 47/16; B65D 1/265; B65D 7/00; B65D 13/00; B65D 25/22; B65D 2525/00; B65D 2563/00; B65D 61/00; B65D 75/525; B65D 90/125; B65D 90/14
USPC ..... 220/737, 738, 739, 740, 741, 742, 743, 220/720, 476, 480; 248/309.1, 316.1, 248/316.7; 297/188.14, 188.2
See application file for complete search history.

(56) References Cited

U.S. PATENT DOCUMENTS 697,901 A * 4/1902 Thurber ..... A47G 29/08 248/316.7
4,819,843 A * 4/1989 Nakayama ..... B60N 3/103 108/44
4,880,133 A * 11/1989 Cullinane ..... A47C 7/62 220/737
5,147,342 A * 9/1992 Kane ..... A61B 10/0045 220/737
5,279,452 A * 1/1994 Huynh ..... B60N 3/103 108/46
5,720,516 A 2/1998 Young
5,730,339 A * 3/1998 Stolfo ..... A45F 5/02 220/737
6,227,511 B1 * 5/2001 De Costa ..... A47C 7/62 248/311.2
8,757,573 B1 * 6/2014 Barnes, Jr. ..... A47G 23/0225 220/737
9,345,353 B2 * 5/2016 Forbes ..... G09F 21/04
2005/0218149 A1 * 10/2005 Walsh ..... B44D 3/127 220/737

(Continued)

FOREIGN PATENT DOCUMENTS

WO 2016059416 A1 4/2016

*Primary Examiner* — Kareen K Thomas
(74) *Attorney, Agent, or Firm* — Northern Michigan Patent Law, PLC

(57) ABSTRACT

A folding popcorn and drink holder useful for carrying a bucket of popcorn and a drink to a seat, and for being mounted in an armrest type cup holder at the seat. The holder has a folded configuration that is relatively flat, compact, and can be stored inside an empty popcorn bucket or hung vertically on the side of the bucket.

9 Claims, 8 Drawing Sheets

(56) References Cited

U.S. PATENT DOCUMENTS

| | | | | |
|---|---|---|---|---|
| 2008/0060479 | A1* | 3/2008 | Nelson | B67B 7/16 81/3.09 |
| 2010/0096396 | A1* | 4/2010 | Doig | B60N 3/102 220/737 |
| 2014/0299615 | A1* | 10/2014 | Van Gelder | B65D 25/2894 220/737 |
| 2015/0313385 | A1* | 11/2015 | McDonough | A47G 23/0225 220/737 |
| 2016/0038375 | A1* | 2/2016 | Hesketh | A61M 5/1417 220/737 |
| 2017/0086603 | A1* | 3/2017 | Sortino | A47G 23/02 |
| 2017/0202356 | A1 | 7/2017 | Penas Varo | |
| 2017/0215582 | A1* | 8/2017 | Berger | F21V 33/008 |
| 2017/0332794 | A1* | 11/2017 | Melaragno | F16B 2/005 |

* cited by examiner

FOLDING POPCORN HOLDER

RELATED APPLICATIONS/PRIORITY BENEFIT CLAIM

This application claims the benefit of U.S. Provisional Application No. 62/635,295, filed Feb. 26, 2018 by the same inventor (Tannehill), the entirety of which provisional application is hereby incorporated by reference.

FIELD

The subject matter of the present application is in the field of devices for holding snacks and drinks from a convenient spectator support such as a chair, and in particular from a cupholder formed in the support.

BACKGROUND

Devices that can be mounted in armrest cup holders for holding refreshments such as popcorn and drinks are known.

U.S. Pat. No. 5,720,516 to Young shows a concession goods holder for attachment to a cup holder. The holder includes a step-sided cup holder sized for insertion into the cup holder of a stadium or theater seat armrest, and a U-shaped resilient bracket for holding a bag of popcorn off the end of the armrest.

U.S. Published Application No. 2017/0202356 A1 to Penas Varo discloses a support for holding popcorn containers at the end of a movie theater armrest. The support has a vertical mast with a hook for engaging the side of an armrest cup holder on one side, and on the other side the options of 1) a resilient clamping ring that goes around a bucket of popcorn, or 2) an inverted hook on a telescoping-adjustable arm that hooks the top edge of a bucket of popcorn. A horizontal platform extends from the lower end of the mast to provide a support for the popcorn container, and can be hinged to fold to reduce the holder's volume when not in use.

Published International Application WO2016059416A1 to Haughey (Handy Andy Products Limited) discloses a cup-and-popcorn holder that also shows a cup-shaped cup holder insert to secure the holder to an armrest, and a vertical mast with a beverage or popcorn holding ring spaced above a horizontal support platform. In several embodiments the mast has a hook end for removable connection to the cup holder insert.

The prior art devices above appear to be bulky where the cup holder insert is integrated with the popcorn holder portion, fussy to use, and/or weak and prone to breakage where the popcorn holder portion is removably attached to the cup holder insert.

BRIEF SUMMARY

The present invention is an improved popcorn holder configured to be mounted in an armrest cup holder, for example of the type found in theater and stadium seats and lounge chairs. The popcorn holder is especially configured for holding a bucket or other cylindrical container of popcorn or other snack food, although it can also be used to hold non-cylindrical snack containers such as cartons and bags. The inventive popcorn holder is sturdy; durable; functional as a snack and beverage carrier on the way to the seat; and, has a folded configuration for secure storage in an empty popcorn bucket, for example when offered for sale at a concession stand prior to being filled with popcorn.

The popcorn holder comprises a ring, hoop, or clamp member (hereafter generally "ring") having a diameter or width sufficient to substantially encompass the exterior of a popcorn bucket; a cup holder insert configured to fit snugly into a cup holder in an armrest; and a horizontal extension arm connecting the ring to the cup holder insert. A vertical post extends downwardly from the horizontal arm at a location between and spaced from both the ring and the cup holder insert, the vertical post having a horizontal support arm extending laterally outward to a location below the ring.

In a further form, the vertical post and the ring are attached to the horizontal extension arm at a common pivot point at an outer end of the extension arm offset outwardly from the axis of the vertical post.

In yet a further form, the horizontal support arm can be folded into parallel engagement with the vertical post. The horizontal support arm may also include a telescoping end.

In still a further form, the horizontal extension arm includes a recessed thumb rest or saddle on an upper surface thereof, preferably offset from the vertical post.

The ring and the vertical post can be folded about their common pivot point to a substantially flat position centered over the cup holder insert, so that the cup holder insert and the vertical post are contained within the interior of the ring when viewed vertically. The folded popcorn holder can be stored inside a popcorn bucket or similar cylindrical container, the ring having sufficient flexibility to both fit into the interior diameter of the container and to fit around the exterior of the container.

The folded popcorn holder may also be hung vertically from the top edge of a rigid container by a hook member formed on the vertical post.

The inventive popcorn holder can also be used to hold drink containers, ice cream containers, and other snack containers too big to insert in an armrest cup holder. "Armrest cup holder" should be understood to include similar cup holders in other types of furniture. "Popcorn" and "popcorn bucket" will accordingly be used throughout to mean any sort of snack and any accompanying bucket, cup, bag, or similar container of the type in which a loose or unformed quantity is combined with the container and subsequently taken to a seat and consumed from the container.

These and other features and advantages of the invention will become apparent from the detailed description below, in light of the accompanying drawings.

DETAILED DESCRIPTION

Figure 1:
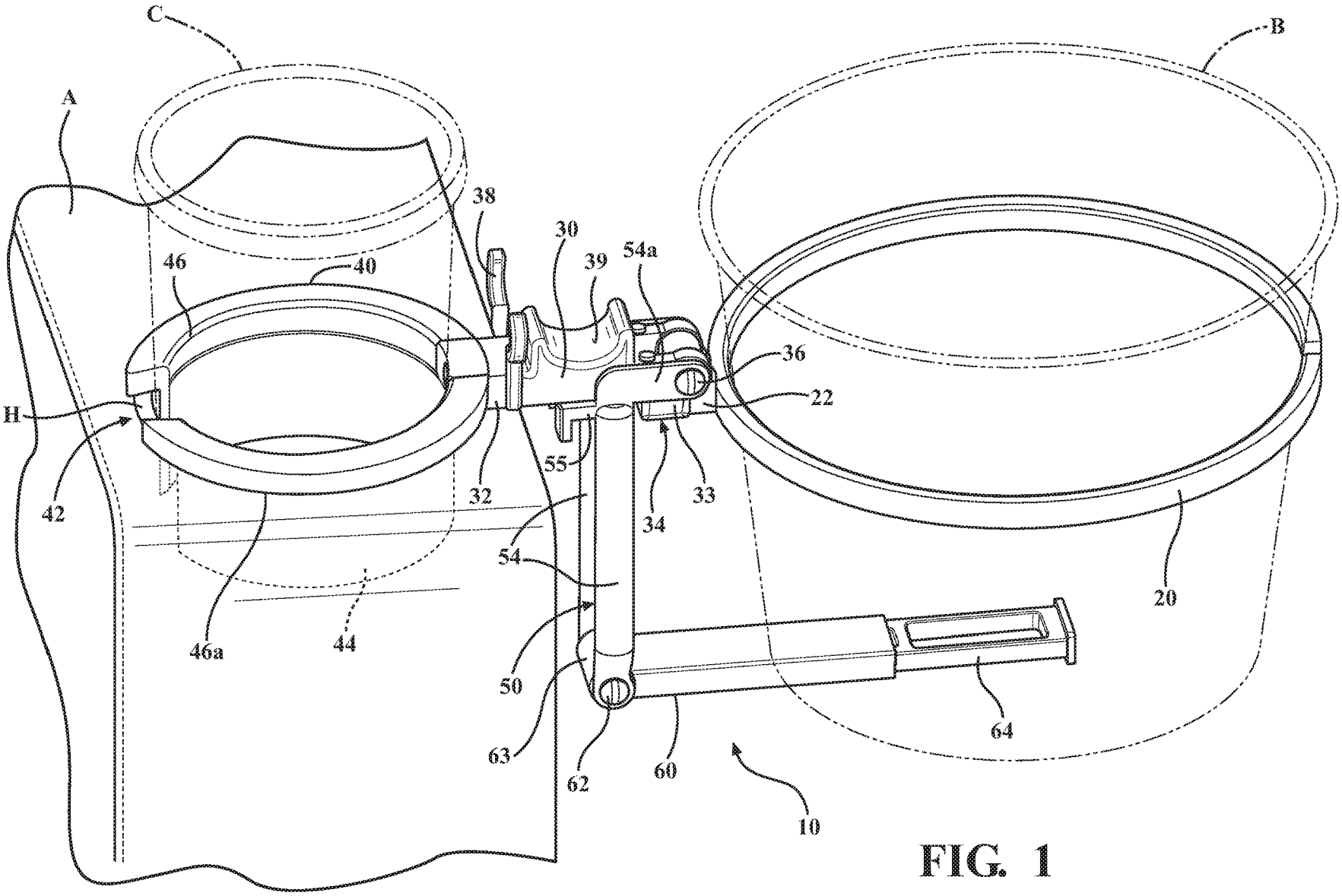
FIG. 1 is a perspective view of an exemplary popcorn holder according to the invention, shown in relation to an armrest cup holder.

Referring first to FIG. 1, a popcorn holder 10 is shown in exemplary form in order to teach how to make and use the claimed invention. Popcorn holder 10 has a ring member 20 which may comprise a continuous ring or a split ring (pictured) or a set of clamping jaws configured to fit around an outside diameter of a typical concession-type popcorn bucket. While illustrated ring 20 is circular, other container-encompassing shapes such as oval or rectangular are possible to fit different containers, and should be considered as being included in the term "ring". Ring 20 and most or all of the portions of popcorn holder 10 are preferably made from a durable, resilient plastic, although other materials or combinations of materials may be used.

Ring 20 is connected by a horizontal extension arm 30 to a cup holder insert 40. Cup holder insert 40 is a generally circular or cup-shaped piece, in the illustrated example in the form of a split cylinder with a rear opening 42 for flex, and with a lower body 44 of a first diameter for insertion into a cup holder H in an armrest and for receiving a drink cup C or similar. An upper flange 46 has a second larger diameter with a lower surface 46*a* configured to rest on the surface of an armrest A around the cup holder H.

Horizontal extension arm 30 spaces ring 20 outwardly from cup holder insert 40 a distance sufficient to extend the ring beyond the end or side of armrest A. Preferably, an inner part 32 of arm 30 with a generally flat lower surface rests on the armrest, while an outer part 34 of arm 30 extends beyond the armrest. FIG. 1 shows popcorn holder 10 rotated to extend off the side of an armrest, for example where the chair is on the end of a row, or where the chair is a standalone chair, but it will be understood that popcorn holder 10 can also be rotated ninety degrees to extend off the end of the armrest in line with the length of the armrest, or set at various angles in between.

A vertical post 50 extends downwardly from horizontal extension arm 30, sufficiently long to position a horizontal support arm 60 extending from the post's lower end to receive the bottom of a popcorn bucket B after a significant portion of the bucket has been inserted through ring 20. Post 50 is also sufficiently long in a preferred form to function as a vertical hand grip, described in further detail below, and for that purpose is preferably located in a generally central location on extension arm 30 for balance.

Horizontal support arm 60 preferably folds toward and away from post 50 for compact storage, in the illustrated example pivotally connected at 62 to the lower end of post 50 on a pivot pin 62 extending through the mating ends of the post 50 and a bushing 63 on the inner end of the support arm 60. In the illustrated example, post 50 is formed by a pair of spaced sidewall members 54 with a space between them sized and shaped to receive horizontal support arm 60 therebetween when the support arm 60 is pivoted upwardly, for more compact storage. Storing support arm 60 in the interior of post 50 also structurally strengthens the post 50 when the post is used as a grip. Support arm 60 may have a telescoping extension 64 to extend its length relative to the popcorn bucket held in ring 20 when deployed and to fit within the dimensions of post 50 when stored.

Figure 2A:
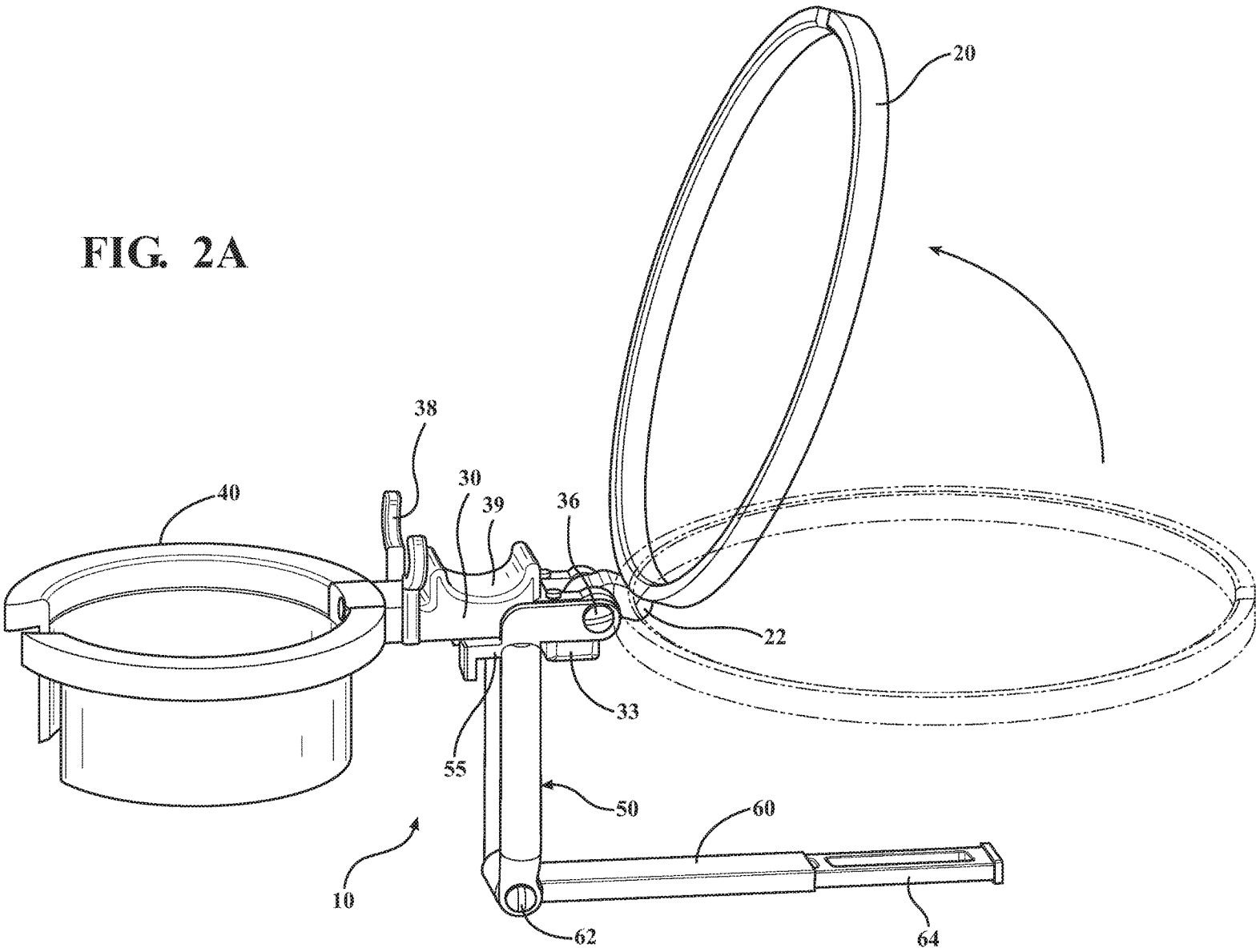
FIGS. 2A, 2B, and 2C are perspective views of the popcorn holder of FIG. 1 in different stages of folding, respectively.
Figure 2B:
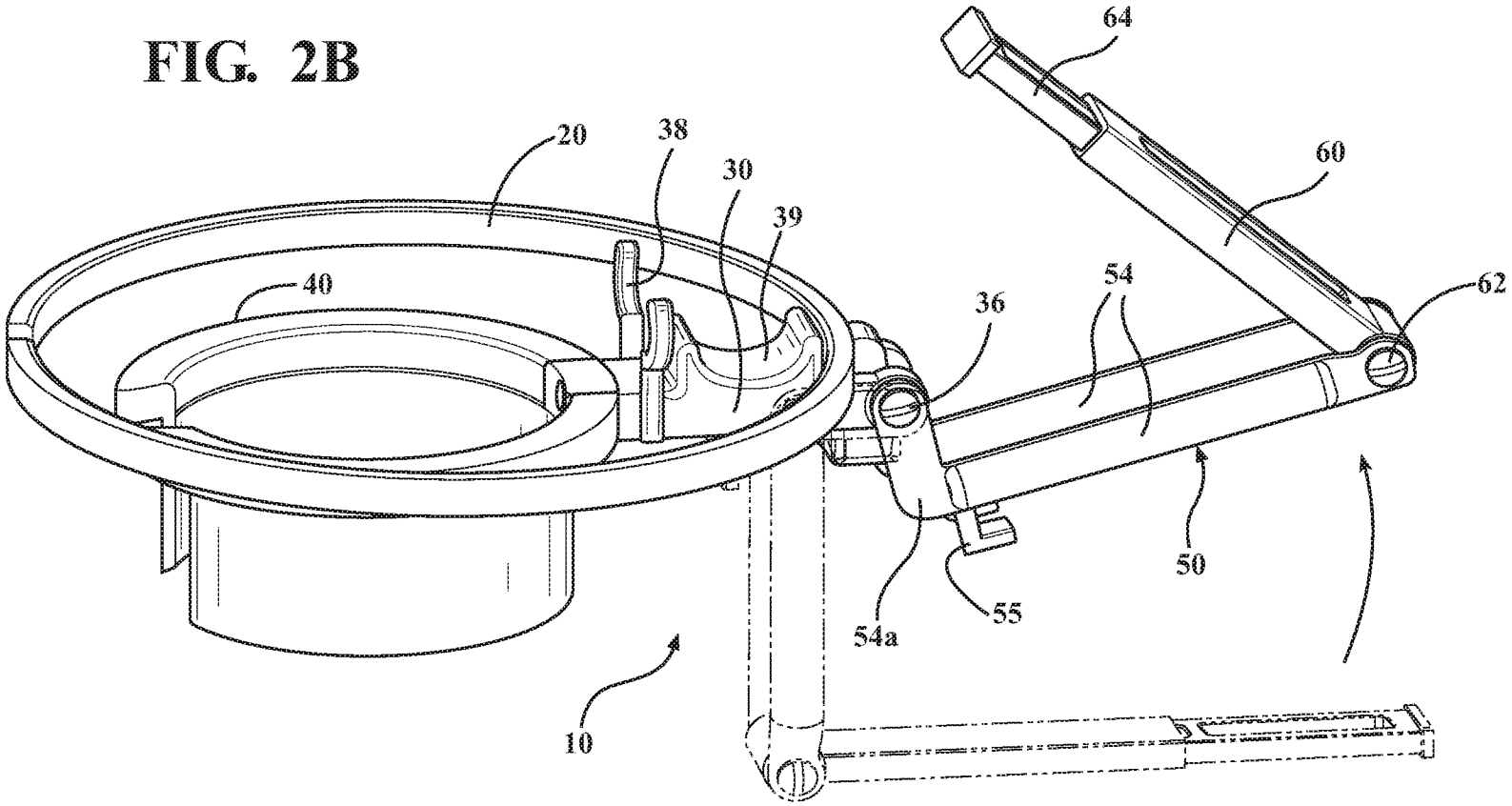
Figure 2C:
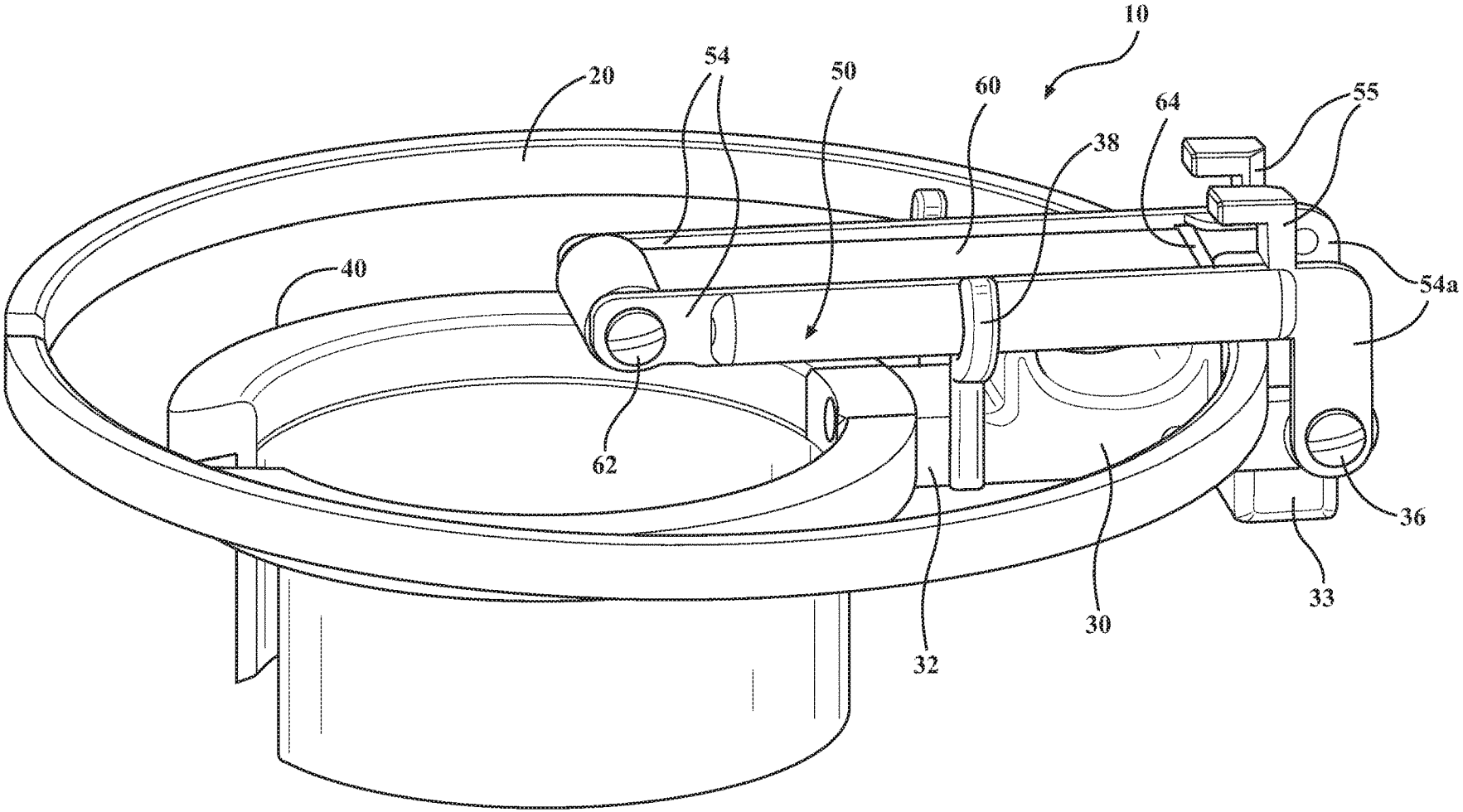

Ring 20 and post 50 are pivotally connected to horizontal support arm 30 at a common pivot 36 on the outer end 34 of the support arm. Pivot connection 36 in the illustrated example is a pivot pin 36 extending through aligned bushing bores 37 in the outer end of horizontal extension arm 30 and in outer, upper flange ends of post 50. The common pivot connection 36 allows for an approximate 180-degree rotation of ring 20 between its open (FIG. 1) and folded (FIGS. 2C and 3) configurations, and for an approximate 270-degree rotation of post 50 about the pivot axis between the open and folded configurations. FIGS. 2A-2C show ring 20 and post 50 in various stages of folding or pivoting until they lie centered above and essentially parallel to the upper surface of cup holder insert 40 as shown in FIG. 3.

The inner end of ring 20 is connected to pivot 36 through a pivot bushing 22 with a bore for the pivot pin. Pivot bushing 22 provides a co-acting stop with a stop-block 33 formed on the outer end of horizontal extension arm 30 to positively limit the rotation of ring 20 relative to the remainder of the popcorn holder in the open configuration.

The pivot connection of vertical post 50 to pivot 36 is through an L-shaped horizontal pivot flange 54*a* formed on the upper end of each of the spaced sidewall members 54. The pivot connection for vertical post 50 is accordingly offset outwardly from the vertical axis of the post in the open configuration. Rotation of the vertical post 50 to the open configuration is limited by horizontal stops 55 extending inwardly from the upper ends of the spaced sidewall members 54 and positioned to abut the underside of horizontal extension arm 30 when post 50 reaches its vertical position.

Figure 3:
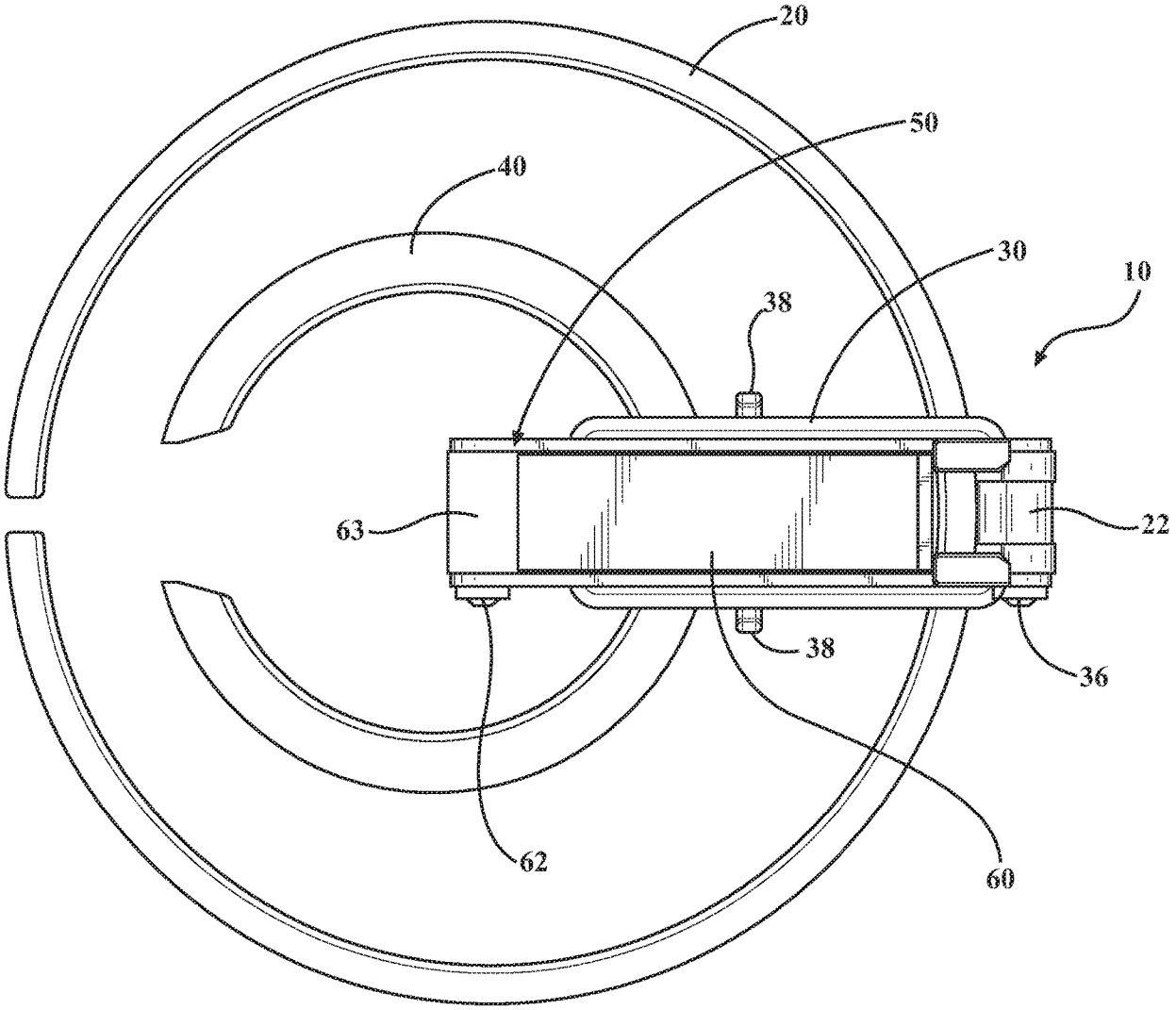
FIG. 3 is a top plan view of the folded popcorn holder of FIG. 1.

Referring to FIG. 3, ring 20, vertical post 50, and horizontal support arm 60 can be folded around pivot 36 over the top of horizontal extension arm 30 to a folded configuration generally over and aligned with cup holder insert 40 for compact, sturdy storage. In the illustrated example, horizontal extension arm 30 is shown provided with a retainer clamp 38 comprising a pair of curved, spaced, resilient fingers adapted to receive vertical post 50 with a snap fit to lock the folded post in place. Ring 20 is trapped between cup holder insert 40 and post 50 in the folded configuration. The folded parts of the popcorn holder accordingly help protect and secure one another in storage.

Figure 4:
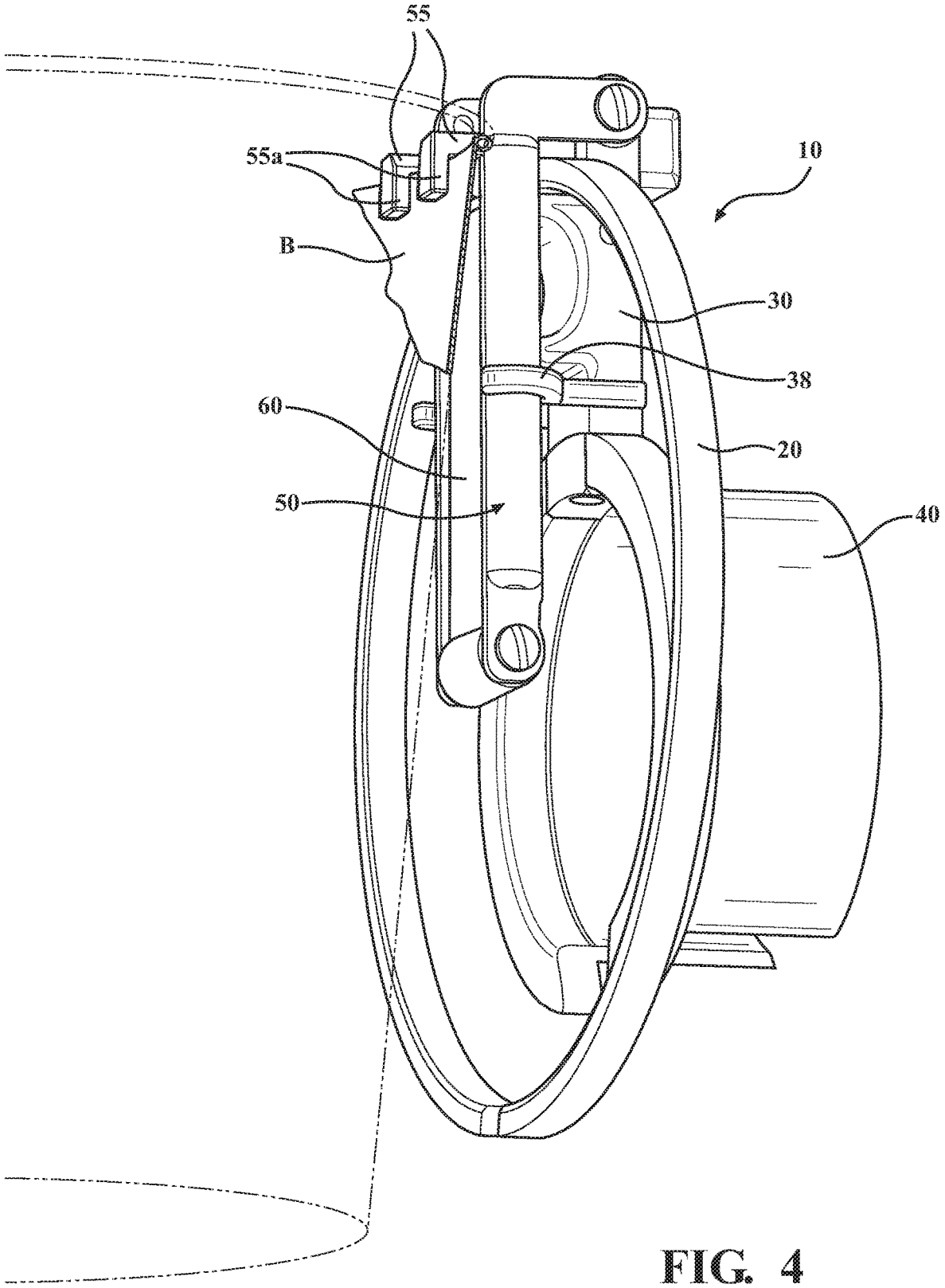
FIG. 4 is a perspective view of the folded popcorn holder of FIG. 1 stored on the edge of a popcorn bucket.

Referring to FIG. 4, folded popcorn holder 10 is shown stored in a preferred vertical orientation on an empty popcorn bucket B. While popcorn holder 10 can be inserted loosely inside bucket B, stops 55 have an L-shape with angled outer ends 55*a* that are exposed above and near the outer end of horizontal extension arm 30 in the folded configuration. In this position, stops 55 function as hooks when the folded holder is oriented vertically, capable of being hung on the rim of bucket B or any similar open-topped container. If the spacing between angled outer ends 55*a* and the main body of stops 55 corresponds to the thickness of the bucket rim, the fit can be a tight frictional engagement to lock the folded, vertically oriented holder 10 in place on the inside or (as shown) on the outside wall of the bucket.

Figure 5:
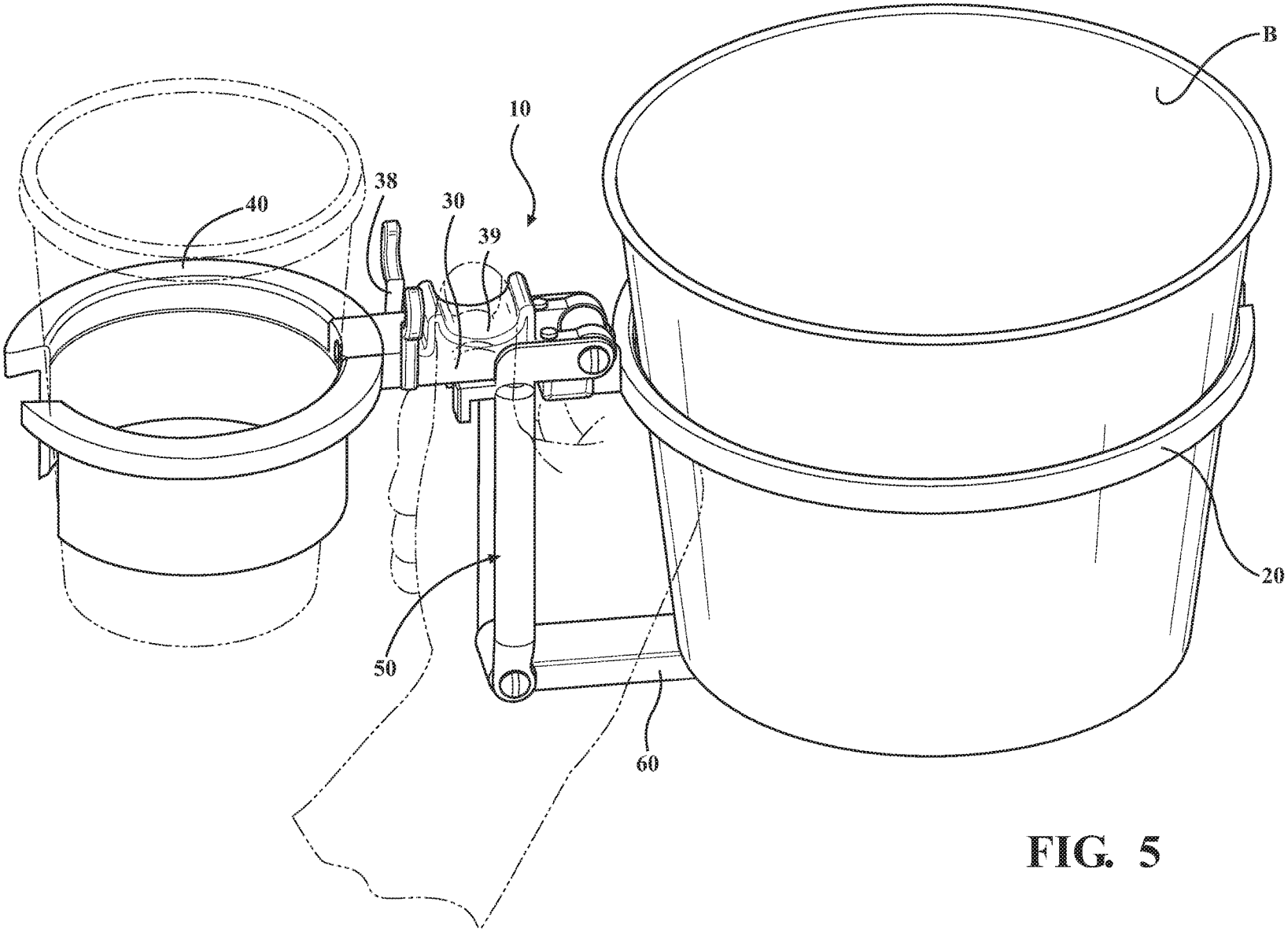
FIG. 5 shows the popcorn holder of FIG. 1 being used as a carrier to take beverages and snacks from a concession stand or serving location to a seat.

Referring now to FIG. 5, popcorn holder 10 is shown in the open configuration being used as a convenient, balanced carrier for carrying a bucket of popcorn and a drink from a concession stand to the user's seat using only one hand. Vertical post 50 forms a hand grip beneath horizontal extension arm 30, generally centered between the cup holder insert (and inserted drink) and ring 20 (and inserted bucket of popcorn). To help hold the weight of the drink and popcorn more securely, the upper surface of horizontal extension arm 30 may be provided with a recessed thumb rest 39 in the form of a rounded groove with an axis extending perpendicular to the length of the horizontal extension arm. Thumb rest 39 is preferably offset inwardly toward the cup holder insert 40 relative to the vertical axis of post 50, to accommodate the offset of the thumb from the fingers. The ability to use holder 10 as a carrier with one hand allows a moviegoer to hold a child's hand or open the theater door on the way to a seat. Used as an armrest popcorn-and-drink support, holder 10 makes it easy to share popcorn, and eliminates the need to hold popcorn on the lap or to set it on the floor.

Figure 6:
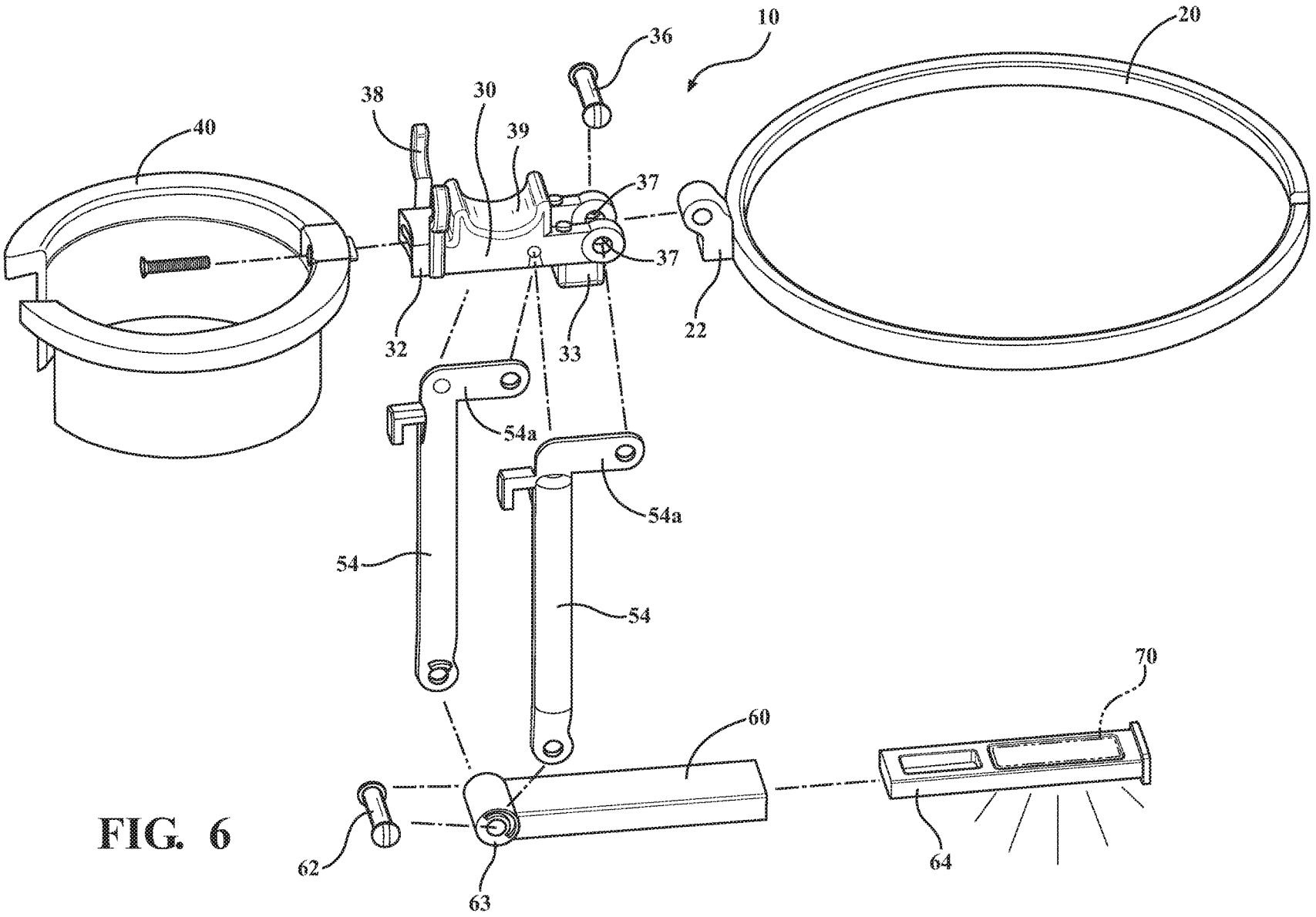
FIG. 6 is an exploded assembly view of the popcorn holder of FIG. 1.

As a further option shown in FIG. 6, a small battery-powered light 70 may be located on horizontal support arm 60, for example a reading-light type LED array of known type secured in an opening in telescoping extension 64 and powered by its own internal battery or a battery stored in the arm 60. Light 70 shines downwardly when arm 60 is horizontal in the holder's open configuration, helping to light a person's way to the seat, and/or providing an unobtrusive aisle or row light below the level of the armrest when the holder is mounted to a cup holder.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A holder for popcorn, drinks, and container-packaged snacks, the holder comprising:

a ring having a diameter or width sufficient to substantially encompass an exterior of a snack container;

a cup holder insert configured to fit snugly into an armrest cup holder associated with a seated entertainment or a relaxation location;

a horizontal extension arm connecting the ring to the cup holder insert in a horizontally spaced fashion when the popcorn holder is in an open configuration; and, further wherein in the open configuration a vertical post extends downwardly from the horizontal extension arm at a location between and spaced from both the ring and the cup holder insert, and wherein a horizontal support arm extends from a lower end of the vertical post laterally outward to a location below the ring.

2. The holder of claim 1, wherein the vertical post and the ring are attached to the horizontal extension arm at a common pivot connection with a common pivot axis at an outer end of the horizontal extension arm offset outwardly from a vertical axis of the vertical post in the open configuration.

3. The holder of claim 2, wherein the holder has a folded configuration in which the ring and vertical post are folded inwardly over the horizontal extension arm from the open configuration to a substantially flat horizontal position above and generally aligned with and parallel to the cup holder insert and the horizontal extension arm.

4. The holder of claim 1, wherein the horizontal extension arm includes a thumb rest region on an upper surface thereof above the vertical post when the vertical post is vertical in the open configuration.

5. The holder of claim 3, wherein the horizontal extension arm includes a retainer member on an upper surface thereof, the retainer member configured to receive the vertical post in a retaining fit when the vertical post is rotated to the substantially flat horizontal position over the horizontal extension arm in the folded configuration.

6. The holder of claim 1, wherein the horizontal support arm is pivotally connected at an inner end to the lower end of the vertical post, and further wherein the horizontal support arm is configured to be folded into parallel engagement with the vertical post.

7. The holder of claim 6, wherein the vertical post comprises spaced sidewall members defining a space between them sufficient to receive the horizontal support arm therein when the horizontal support arm is folded into parallel engagement with the vertical post.

8. The holder of claim 1, wherein the horizontal support arm comprises a telescoping extension to extend the length of the horizontal support arm relative to the ring in the open configuration.

9. The holder of claim 3, wherein the vertical post comprises a hook on a rear side thereof configured to vertically engage an upper edge of a popcorn bucket to hang the holder vertically from an upper edge of a popcorn bucket when the holder is in the folded configuration.

* * * * *